United States Patent [19]

Stendahl

[11] Patent Number: 4,593,478

[45] Date of Patent: Jun. 10, 1986

[54] PRESSURE-REDUCING VALVE

[75] Inventor: Gunnar Stendahl, Västerås, Sweden

[73] Assignee: AB Asea-Atom, Västerås, Sweden

[21] Appl. No.: 600,024

[22] Filed: Apr. 13, 1984

[30] Foreign Application Priority Data

Apr. 15, 1983 [SE] Sweden ..... 8302105

[51] Int. Cl.[4] ..... F26B 17/00

[52] U.S. Cl. ..... 34/57 R; 34/57 A; 138/42

[58] Field of Search ..... 34/10, 57 A, 57 R; 55/242, 269, 474, 479; 138/42

[56] References Cited

U.S. PATENT DOCUMENTS

| | | | |
|---|---|---|---|
| 2,508,224 | 5/1950 | Carter | 138/42 |
| 3,313,035 | 4/1967 | Crawford et al. | 34/57 R |
| 3,343,340 | 9/1967 | Couch | 138/42 |
| 3,477,467 | 11/1969 | Sewell et al. | 137/599 |
| 3,677,300 | 7/1972 | King | 138/42 |
| 3,866,630 | 2/1975 | Webb et al. | 138/42 |
| 3,907,527 | 9/1975 | Onnen | 55/474 |
| 4,146,371 | 3/1979 | Melcher et al. | 55/474 |
| 4,334,898 | 6/1982 | Zhuber-Okrog et al. | 55/474 |
| 4,354,862 | 10/1982 | Sgaslik | 55/479 |
| 4,424,766 | 1/1984 | Boyle | 110/245 |

*Primary Examiner*—Albert J. Makay
*Assistant Examiner*—David W. Westphal
*Attorney, Agent, or Firm*—Watson, Cole, Grindle & Watson

[57] ABSTRACT

A pressure-reducing valve for a dust-entraining gaseous or liquid fluent flow comprises a vertical tube containing a bed of particles which are fluidized by the flow. The particles have considerably greater specific weight than the dust in the flow, so that the particles in the bed are not carried away by the flow. The valve may be used to permit the continuous egress of a dust-contaminated flow from a pressurized container, for example a cyclone, while maintaining the pressure in the container. If the fluent flow is hot, the valve tube may be surrounded by a cooling jacket for extracting heat therefrom. The height of the bed in the tube may be adjusted to and from a particle storage, at the lower and upper ends, respectively, of the tube.

12 Claims, 1 Drawing Figure

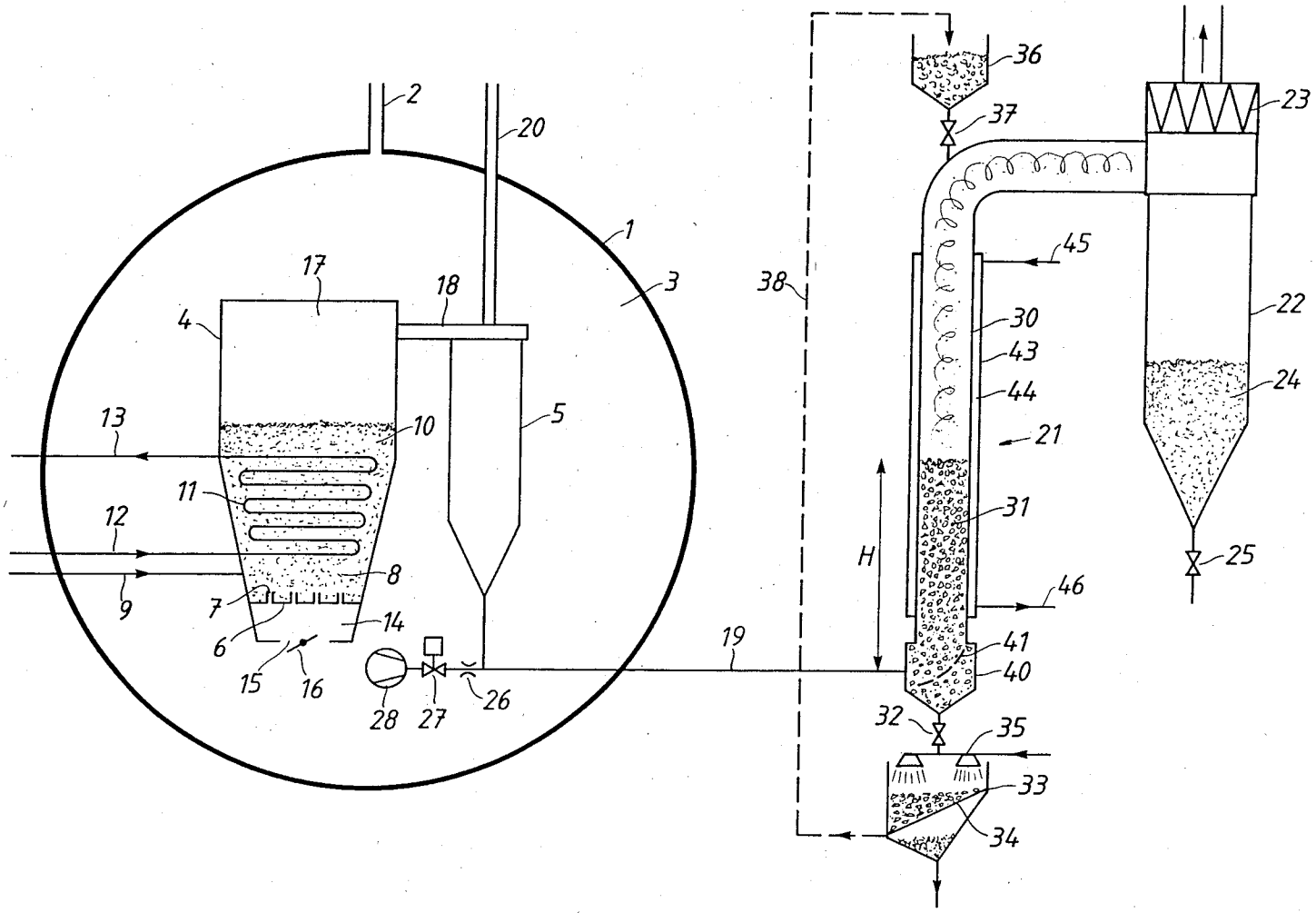
23
22
24
25
45
46
36
37
30
43
44
21
31
41
40
35
33
34
32
H
38
19
3
1
20
5
26
18
27
2
10
8
14
28
17
16
15
6
7
4
11
13
12
9

PRESSURE-REDUCING VALVE

BACKGROUND OF THE INVENTION

The present invention relates to a pressure-reducing valve means for controlling the outflow of a fluid mixed with dust from a pressurized container. The pressurized container may be a cyclone so that it is intended that the exiting fluid includes dust entrained therein, or it may be a question of controlling the release of excess air from a container, the air being contaminated with dust.

To maintain the flow at the desired level, it may be necessary to slow it down. Normally, because of the dust admixture, it is then not possible to use conventional pressure-reducing valve means with movable parts, in part because of the inevitable wear of valve parts which would be caused by the entrained dust and in part because of the substantial risk that gaps and spaces in the valves can accumulate dust particles with the ensuing risk of a blocking of otherwise movable parts.

SUMMARY OF THE INVENTION

The present invention provides a very simple construction of pressure-reducing valve means in which the only movable parts are constituted by a mass of particles forming a bed which is fluidized by the flow. A valve means according to the invention comprises a vertical tube containing a mass of fluidizable particles, whereby the fluent flow enters the lower end of the tube and fluidizes the bed in flowing up through it. In order that bed material shall not accompany the dust through the valve means, the particles making up the bed should have a greater specific weight or a greater velocity of fall than the entrained dust. At moderate temperatures the bed may be made up of lead balls, whereas at higher temperatures balls of more difficultly fusible materials, for example steel or rock material, can be used. The particle size for the bed material should be selected in relation to the nature of the dust and the rate of fluent flow in question.

The fluent flow may consist of air mixed with dust, but a valve means according to the invention is usable with any type of continuous medium, that is, with both gaseous and liquid media mixed with dust of any given solid material. For each particular fluent flow, it will only be a question of selecting, on the basis of dimensions known to work with other substances what is the optimum bed material and how deep a bed should be used for the flow rates expected.

BRIEF DESCRIPTION OF THE DRAWING

A pressure-reducing valve means in accordance with the invention will now be described, by way of example, with reference to the accompanying drawing, the sole FIGURE of which shows, schematically, a pressurized fluidized bed combustion plant (PFBC plant) utilizing a pressure-reducing valve means according to the invention.

DESCRIPTION OF THE PREFERRED EMBODIMENT

In the drawing, the numeral 1 designates a pressure vessel of a PFBC plant. Through a pipe 2, the space 3 within the pressure vessel 1 is supplied with combustion air at a pressure of up to about 2 MPa from a compressor (not shown). The pressure vessel 1 encloses a combustion chamber 4, a gas-cleaning cyclone 5 and other auxiliary equipment necessary for the operation of the plant. The cyclone 5 shown in the drawing symbolizes in reality parallel-connected groups of series-connected cyclones.

The combustion chamber 4 is provided with a bottom plate 6 having nozzles 7 passing therethrough. In the lower part of the combustion chamber 4 a fluidized bed 10 of granular material is located and a cooling coil 11 is embedded therein for regulating the bed temperature and for generating steam which is supplied to a steam turbine (not shown). The cooling coil 11 is supplied with feed water through a line 12 and steam created in the cooling coil leaves through a line 13. Fuel is supplied to the bed 10 through a fuel line 9.

Below the bottom plate 6 there is defined an air plenum 14 which, via an opening 15 fitted with a regulating flap 16, communicates with the space 3. The volume 17 above the bed 10 in the combustion chamber 4 communicates, via a line 18, with the cyclone 5 in which fly ash, which leaves the combustion chamber 4 together with the combustion gases, is separated from the gases. Clean combustion gases leave the cyclone 5 through a duct 20 which is connected to a gas turbine (also not shown).

Ashes which are separated from the combustion gases in the cyclone 5, are drawn off continuously by means of a transport gas flowing through a line 19 and a pressure-reducing valve means 21 and are then collected in a cyclone-like container 22. The transport gas leaves the container 22 via a filter 23 while collected ashes 24 are tapped off via a valve 25. Gas leaving the cyclone 5 can be used as the transport gas for the ashes. However the line 19 may be supplied, via an ejector 26, with additional transport gas through a valve 27, either directly from the space 3 or via a pressure-increasing booster compressor 28 as shown.

DESCRIPTION OF THE PRESSURE-REDUCING VALVE MEANS

The reducing valve means 21 consists of a vertical tube 30 which contains a fluidized bed 31 of fluidizable particles. The particles forming the bed 31 are fluidized by the ash-entraining gas flow. The particles of the bed 31 must be selected to have such a size, shape and/or specific weight that they remain in the tube 30, while the ash leaves the tube 30 together with the transport gas and is carried over into the container 22 which suitably has the shape of a cyclone separator.

The necessary height H of the particulate bed 31 is dependent on the pressure in the pressure vessel 1 and should be able to be altered in dependence on pressure variations in the vessel 1 due to changes in the power demands made on the plant. For this purpose, the lower part of the pressure-reducing valve means 21 is provided with a sluice or valve device 32 for discharging bed material and a collecting container 33 for the discharged bed material. This container 33 may be provided with a sieve 34 and a sprinkle device 35 for separating ashes accompanying the bed material and washing off any ash coating the particulate bed material. From the container 36 from which it may be returned to the tube 30, via a valve or sluice 37. The transport line between the containers 33 and 36 is symbolized by the dashed line 38. Via the container 36 fresh particulate bed material may be supplied, which replaces bed material lost by erosion (e.g. particles of bed material that have been worn down to such a size that they provide too small a resistance to flow and are carried over with the dust) or augments bed material when a higher pressure drop in the valve means 21 is required.

In order that the pressure-reducing valve means 21 shall have a reasonable height, the particles in the particulate bed 31 should have a high specific weight. They should have such a size and shape that the particulate mass becomes easily fluidizable and at the same time they shall have a considerably higher velocity of fall than the ash which is to pass therethrough, so that the particles are retained in the tube 30 at a gas speed which is capable of forwarding the gas, which has passed the bed 31, to the container 22.

The fluidizable particles of bed material should therefore suitably consist of metal balls with a diameter of 1-2 mm. If the temperature in the flow is not too high, it is possible to use lead balls in order to obtain as short a tube 30 as possible. However, if the temperature in the flow is high, or if the entrained dust particles are hard and sharp-edged (and thus highly erosive), the balls should be of steel or a similar hard material. In that case, the tube 30 has to be made longer, but on the other hand the balls can be cheaper. It is possible to use a gravel of some heavy mineral material for the bed 31. The selection of the particulate mass for the bed may become a compromise between the cost for the tube and the cost for the particulate mass.

At the lower end of the tube 30 there is an extension 40, forming a transition between the tubes 19 and 30. During downtime, this extension is filled with a mass of bed material which becomes deposited a certain distance back inside the tube 19. When the flow is resumed, this mass of bed particles is blown back into the tube 30 so as to form a division between fluidized and non-fluidized material represented by the dashed line 41. Below this line 41 the mass of bed material is not fluidized. In this way, this part of the particulate mass will protect the transition between the tubes 19 and 30. If instead of bed material in the transition between the tubes 19 and 30, the tube 30 were exposed to the gas flow in the tube 19, heavy erosion by the flow would result because of the sharp deflection of the flow. Thus the extension 40 avoids the risk that the wall of the tube 30 would soon be worn down at the transition.

The foregoing description has related to a flow of dust in a gaseous medium. However, it should be understood that a valve according to the invention may just as well be used for a mud-containing, liquid flow medium which is to be transported away from a pressurized container. Similarly, the cyclone 5 illustrated is only to be regarded as one example of a pressurized container from which dust can be removed in a gas stream.

In the embodiment illustrated the invention is utilized as a pressure-reducing valve 21 in an ash discharge system. At the same time it is utilized as an ash cooler and the tube 30 is, for this purpose, surrounded by a cooling jacket 43, and the gap 44 between the tube 30 and the cooling jacket 43 is supplied with a suitable coolant via a coolant supply 45 and drained via a coolant drain 46. The fluidized particulate mass in the bed 31 in the tube 30 is in very good heat transmission relationship to the tube walls so that the heat in the ash and the gases can be recovered in an efficient manner.

Various modifications to the foregoing description are therefore clearly possible within the spirit and scope of the invention as defined in the following claims.

What is claimed is:

1. In a pressurized fluidized bed combustion power plant which includes a combustion chamber in which fuel is burned to produce combustion gases and particulate material, said particulate material being contained in said combustion gases; a cyclone separator in which said particulate material is recovered from said combustion gases, said combustion chamber and said cyclone separator being operated at a first pressure; a collection container for collecting said particulate material, said collection container being operated at a second pressure which is lower than said first pressure; a delivery line for conveying said particulate material from said cyclone separator to said collection container, said particulate material moving through said delivery line by a transport fluid, and a valve means in said delivery line, the improvement wherein said valve means comprises a vertical housing connected in said delivery line such that said particulate material and transport fluid will move continuously upwardly therethrough, said vertical housing having a lower part and an upper part and containing a bed of fluidizable particles, the upward flow of said particulate material and transport fluid through said vertical housing causing said bed of fluidizable particles to become fluidized such that said particulate material and transport fluid will be discharged from the upper part of said vertical housing at said second pressure, said fluidizable particles having a sufficiently greater velocity of fall than the velocity of fall of said particulate material, such that said fluidizable particles will not be discharged from the upper end of said vertical housing.

2. The pressurized fluidized bed combustion power plant as defined in claim 1, wherein said fluidizable particles have a greater density than that of said particulate materials.

3. The pressurized fluidized bed combustion power plant as defined in claim 2, wherein said fluidizable particles comprise metal balls.

4. The pressurized fluidized bed combustion power plant as defined in claim 3, wherein said metal balls comprise lead balls.

5. The pressurized fluidized bed combustion power plant as defined in claim 3, wherein said metal balls comprise steel balls.

6. The pressurized fluidized bed combustion power plant as defined in claim 2, wherein said fluidizable particles comprise gravel.

7. The pressurized fluidized bed combustion power plant as defined in claim 1, wherein said valve means includes supply means connected to the upper part of said vertical housing to add fluidizable particles to the bed therein.

8. The pressurized fluidized bed combustion power plant as defined in claim 7, wherein said valve means includes receiving means connected to the lower part of said vertical housing for receiving fluidizable particles removed from the bed in said vertical housing.

9. The pressurized fluidized bed combustion power plant as defined in claim 8, wherein said valve means includes sprinkling devices for cleaning the fluidizable particles in said receiving means connected to the lower part of said vertical housing.

10. The pressurized fluidized bed combustion power plant as defined in claim 8, wherein said valve means includes a return tranport line connected between said receiving means connected to the lower part of said vertical housing and said supply means connected to the upper part of said vertical housing.

11. The pressurized fluidized bed combustion power plant as defined in claim 1, wherein the lower part of said vertical housing includes an extension portion to which at least a portion of said discharge line is connected.

12. The pressurized fluidized bed combustion power plant as defined in claim 1, wherein said valve means includes a cooling jacket surrounding at least a portion of said vertical housing.

* * * * *